US005991727A

United States Patent [19]

Ono et al.

[11] Patent Number: 5,991,727

[45] Date of Patent: Nov. 23, 1999

[54] VOICE REPRODUCING APPARATUS FOR PERSONAL USE

[76] Inventors: Kazuhiro Ono, No. 10-15, Koyama 7-chome, Shinagawa-ku, Tokyo; Hiroaki Kato, No. 2188-10, Ouzenji, Asao-ku, Kawasaki, both of Japan

[21] Appl. No.: 08/985,549

[22] Filed: Dec. 5, 1997

[51] Int. Cl.[6] ..... G10L 3/00; H04R 1/10

[52] U.S. Cl. ..... 704/270; 434/185

[58] Field of Search ..... 704/200, 201, 704/270, 271, 272, 276, 277; 434/185

[56] References Cited

U.S. PATENT DOCUMENTS

| | | | |
|---|---|---|---|
| 5,056,145 | 10/1991 | Yamamoto et al. | 704/270 |
| 5,163,111 | 11/1992 | Baji et al. | 704/200 |
| 5,365,050 | 11/1994 | Worthington et al. | 704/260 |
| 5,481,616 | 1/1996 | Freadman | 381/333 |
| 5,502,463 | 3/1996 | Sasaki et al. | 345/204 |
| 5,608,700 | 3/1997 | Ikeda | 369/24 |
| 5,655,009 | 8/1997 | Arai et al. | 379/93.28 |
| 5,787,399 | 7/1998 | Lee et al. | 704/270 |
| 5,790,897 | 8/1998 | Corder et al. | 395/892 |
| 5,839,108 | 11/1998 | Daberko et al. | 704/270 |
| 5,845,240 | 12/1998 | Fielder | 704/201 |

FOREIGN PATENT DOCUMENTS 8-151845 12/1997 Japan .

*Primary Examiner*—David R. Hudspeth
*Assistant Examiner*—Martin Lerner
*Attorney, Agent, or Firm*—Evenson, McKeown, Edwards & Lenahan, PLLC

[57] ABSTRACT

A voice reproducing apparatus for personal use is provided with a card serving as a memory-unit accommodating member incorporating therein a memory unit which stores voice as compressed codes; a player body for converting the codes to a voice signal and incorporating therein an interface, a decoding unit, and a circuit portion; and an earphone. The earphone is connected to said card, some of a plurality of contacts of a terminal portion provided in said card are formed as contacts of a terminal portion for an earphone, some of a plurality of contacts of a terminal portion provided in said interface of said player body are formed as contacts of an output terminal portion, and said terminal portion for an earphone is connectable to said output terminal portion when said card is loaded in said player body.

2 Claims, 5 Drawing Sheets

VOICE REPRODUCING APPARATUS FOR PERSONAL USE

BACKGROUND OF THE INVENTION

1. Field of the Invention:

The present invention relates to a voice reproducing apparatus for personal use.

2. Description of the Related Art:

As an apparatus of this type, an apparatus is known which has a form as shown in FIG. 4 and in which a memory card 57 for storing voice as compressed codes is loaded in a player body 51, and voice is heard by an earphone or a headphone 58. This apparatus has a configuration as disclosed in, for example, 1996 National Convention Record, The Institute of Electronics, Information and Communication Engineers (page 199) (published by The Institute of Electronics, Information and Communication Engineers).

In this known apparatus, as shown in FIG. 5 among the accompanying drawings, the player body 51 incorporates therein an interface 52, a decoding unit 53, a circuit portion 54, a battery 55, and a connector 56. The interface 52 is adapted to receive codes from the memory card 57 when the memory card 57 is loaded in the player body 51. The codes are expanded by the decoding unit 53 and are translated into a digital signal. The circuit portion 54 has a D/A conversion unit, an amplifier, a switch, and the like, receives the supply of electric power from the battery 55, converts the digital signal to an analog signal by the D/A conversion unit, amplifies the same by the amplifier, and effects a changeover of operation of the player body by the switch. The voice signal amplified by the amplifier is heard by a user as voice by means of the earphone or the headphone connected to the connector 56.

Such an apparatus can be made compact and lightweight, and is convenient.

In recent years, tests based on voice, such as hearing tests, have been widely conducted in university entrance examinations and the like, in which case voice is outputted from a speaker, and examinees are expected to comprehend what they hear. However, the hearing of voice is liable to be affected by the dimensions of an examination room, the deterioration of sound quality due to reverberation from interior walls, and the external noise, so that it cannot be said that this is a fair method for the examinees. In addition, since a speaker is used, only one type of examination can be conducted in one examination room. When examinations of different types are to be conducted simultaneously, examination rooms and inspectors are required by that number, so that a number of problems are involved.

In this respect, the apparatus in which the aforementioned memory card, in which the contents of examinations which vary on each occasion are stored, is loaded in the player body, and the contents are heard by the earphone is not only unlikely to be affected by the external noise, but is not affected by the dimensions of the examination room, and is desirable in the light of fairness as well, and examinations of different types can be conducted in the same examination room.

However, the aforementioned player body incorporates a connector for connection of the earphone, and it is yet difficult to say that the apparatus has been made sufficiently compact, and the cost has not been lowered by that margin. Further, in the storage of the apparatus, the connection cable of the earphone is likely to become entangled and is therefore difficult to handle.

In entrance examinations or the like, a large number of examinees take examinations at one time. Since the player body is expensive as compared with the memory card and the earphone, the player body is reused after replacing the power supply (battery) and performing inspection. However, it is quite a troublesome operation to inspect the apparatuses in a number corresponding to the number of examinees at one time. Moreover, the examinations are generally conducted only once a year, and the apparatuses must be stored in the normal state in the meantime.

SUMMARY OF THE INVENTION

In view of the above-described circumstances, it is a primary object of the present invention to provide a voice reproducing apparatus for personal use which overcomes the above-described problems and is compact and inexpensive.

A secondary object of the present invention is to provide a voice reproducing apparatus for personal use which is very simple and is not troublesome and which is suitable for use when such apparatuses are used individually by a multiplicity of individuals at one time.

The voice reproducing apparatus for personal use in accordance with a first aspect of the present invention comprises: a memory-unit accommodating member incorporating therein a memory unit which stores voice as compressed codes; a player body for converting the codes in said memory unit to a voice signal as said memory-unit accommodating member is loaded therein; and an earphone for reproducing the voice signal into voice.

The player body incorporates therein an interface for receiving the codes from said memory unit of said memory-unit accommodating member, a decoding unit for translating the codes into a digital voice signal after expanding the codes, and a circuit portion which includes a D/A conversion unit for converting the digital voice signal to an analog voice signal, an amplifier unit for amplifying the analog voice signal, and a switch for effecting a changeover of operation of said player body. In addition, the memory-unit accommodating member can be formed in the shape of a card, whereby the apparatus can be made compact.

To attain the above-described primary object of the present invention, in accordance with the first aspect of the invention, said earphone is connected to said memory-unit accommodating member, some of a plurality of contacts of a terminal portion provided in said memory-unit accommodating member are formed as contacts of a terminal portion for an earphone, some of a plurality of contacts of a terminal portion provided in said interface of said player body are formed as contacts of an output terminal portion, and said terminal portion for an earphone is connectable to said output terminal portion when said memory-unit accommodating member is loaded in said player body.

By virtue of the above-described configuration, a connector connection of the earphone is made unnecessary for the player body, so that the apparatus can be made compact and inexpensive by that margin. Some of the contacts of the terminal portions of the memory-unit accommodating member and the interface are used in place of the conventionally used connectors. Since these contact portions are originally provided in a large number, and since there is leeway in the number, so that they can be used without causing any hindrances.

In addition, to attain the above-described secondary object, in accordance with a second aspect of the invention, in the voice reproducing apparatus for personal use according to the first aspect of the invention, said memory-unit accommodating member incorporates therein a battery for said circuit portion of said player body, some of the plurality of contacts of said terminal portion provided in said memory-unit accommodating member are formed as contacts for a terminal portion for a circuit portion, some of the plurality of contacts of said terminal portion provided in said interface of said player body are formed as contacts of a terminal portion for a power supply, and said terminal portion for a circuit portion is connectable to said terminal portion for a power supply when said memory-unit accommodating member is loaded in said player body.

By adopting the above-described configuration, it goes without saying that the player body can be made compact by the margin in which the player body does not incorporate the battery, but, first and foremost, it becomes unnecessary to perform inspection of the battery. In addition, the battery incorporated in the memory-unit accommodating member is together with the memory-unit accommodating member, so that the battery can be made very compact, and does not make the memory-unit accommodating member large in size.

The above and other objects, features and advantages of the present invention will become more apparent from the following detailed description of the invention when read in conjunction with the accompanying drawings.

DESCRIPTION OF THE PREFERRED EMBODIMENTS

Figure 1:
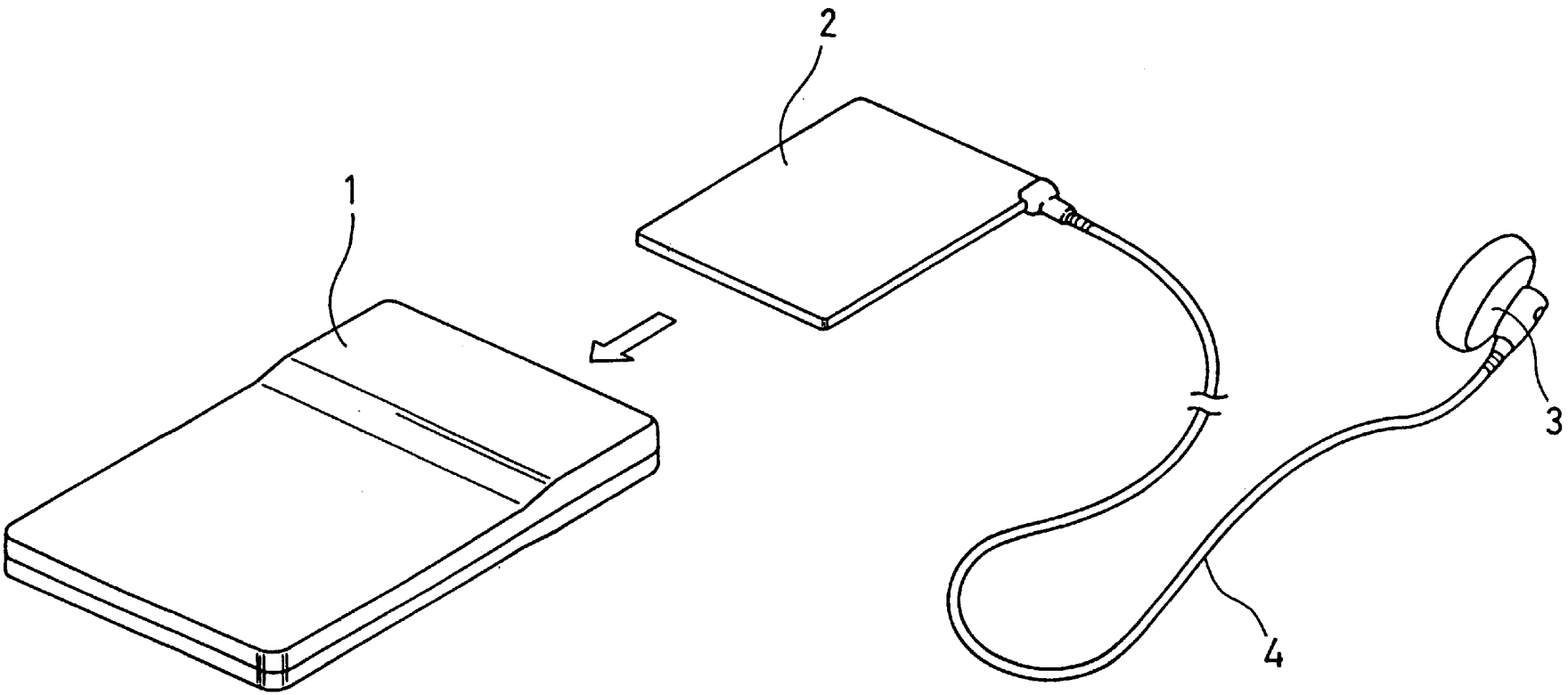
FIG. 1 is a perspective view illustrating the external appearance of the apparatus in accordance with the present invention.
Figure 2:
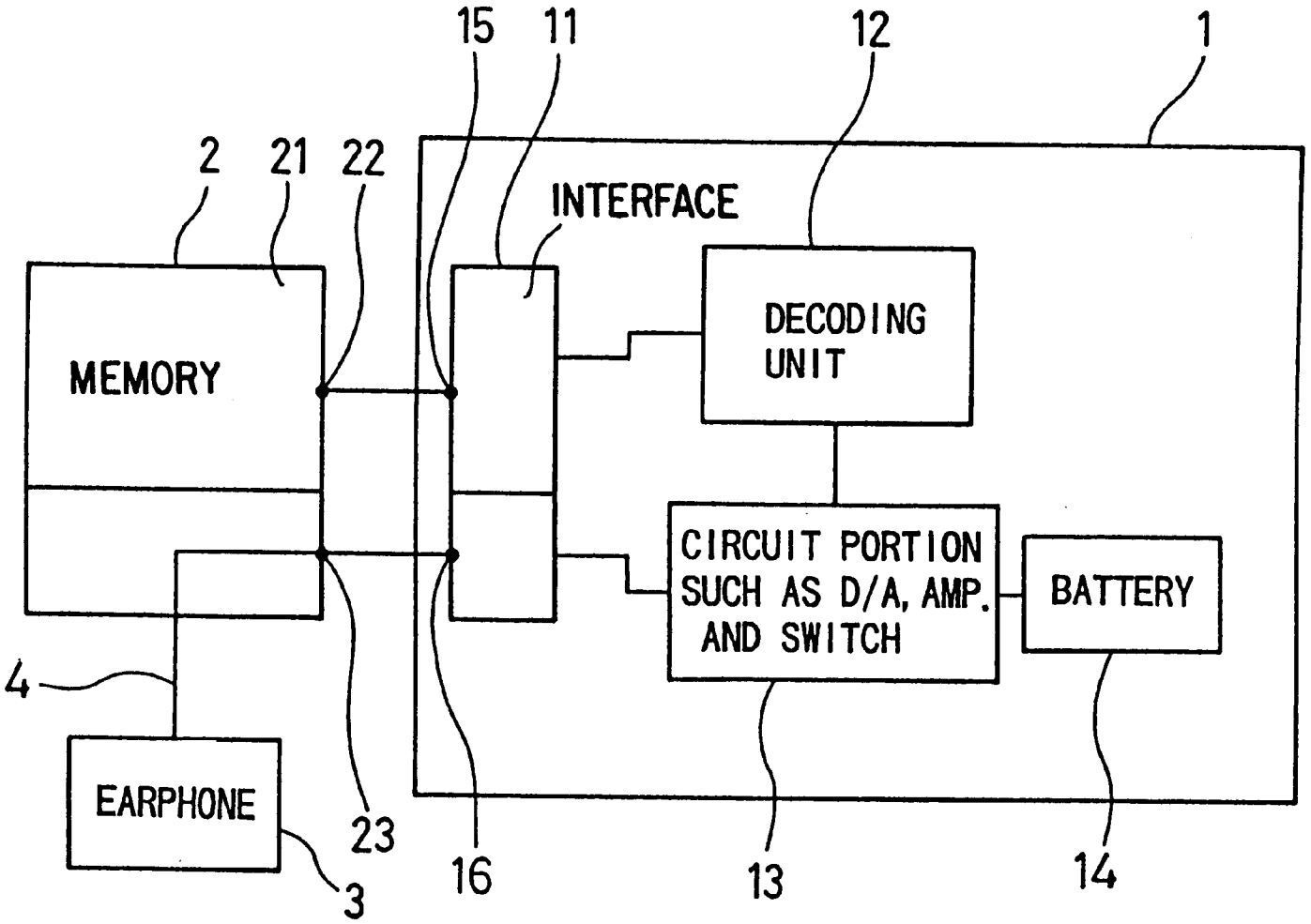
FIG. 2 is a schematic diagram illustrating an embodiment of the apparatus shown in FIG. 1.
Figure 3:
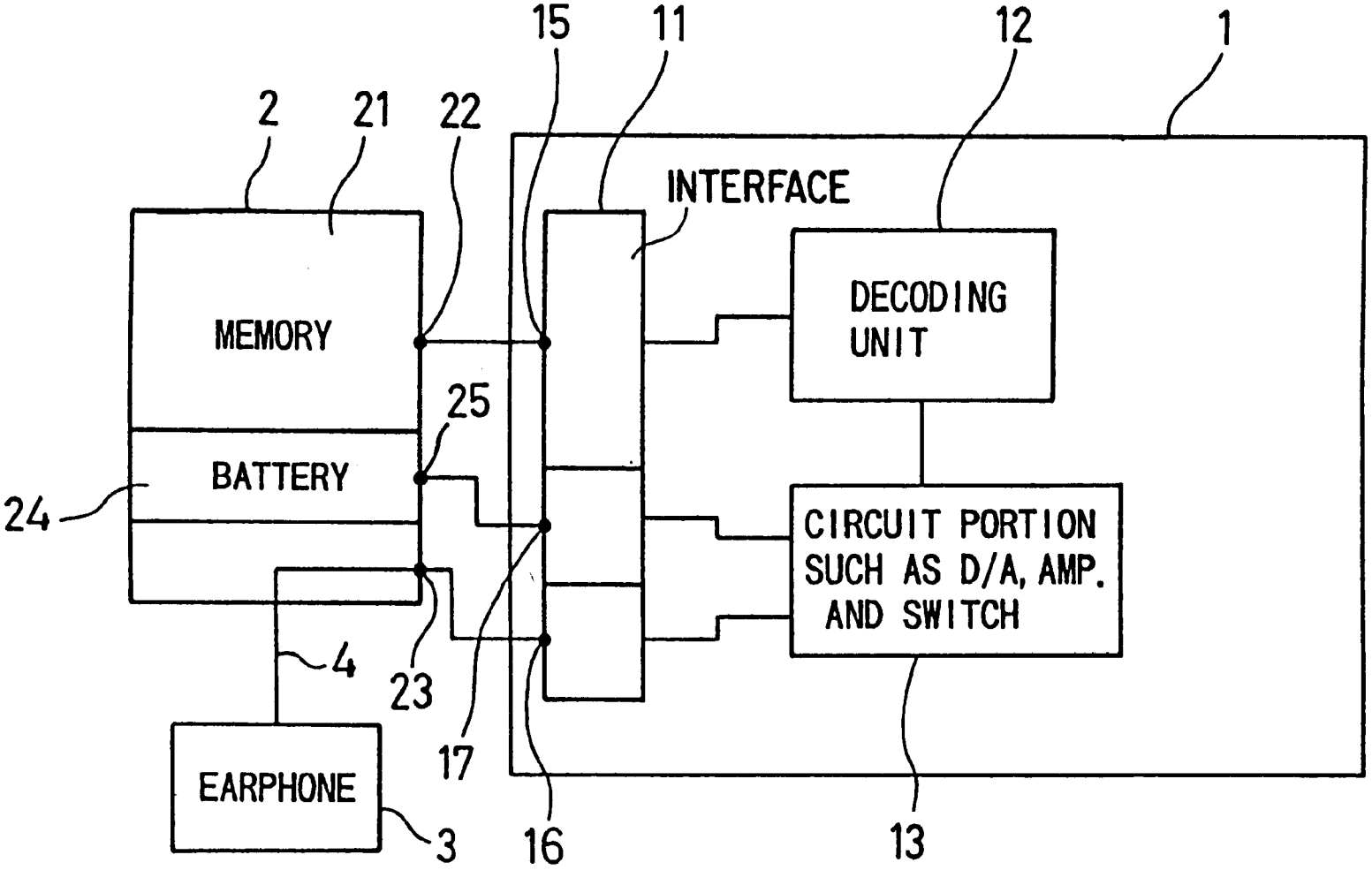
FIG. 3 is a schematic diagram illustrating another embodiment of the apparatus shown in FIG. 1.
Figure 4:
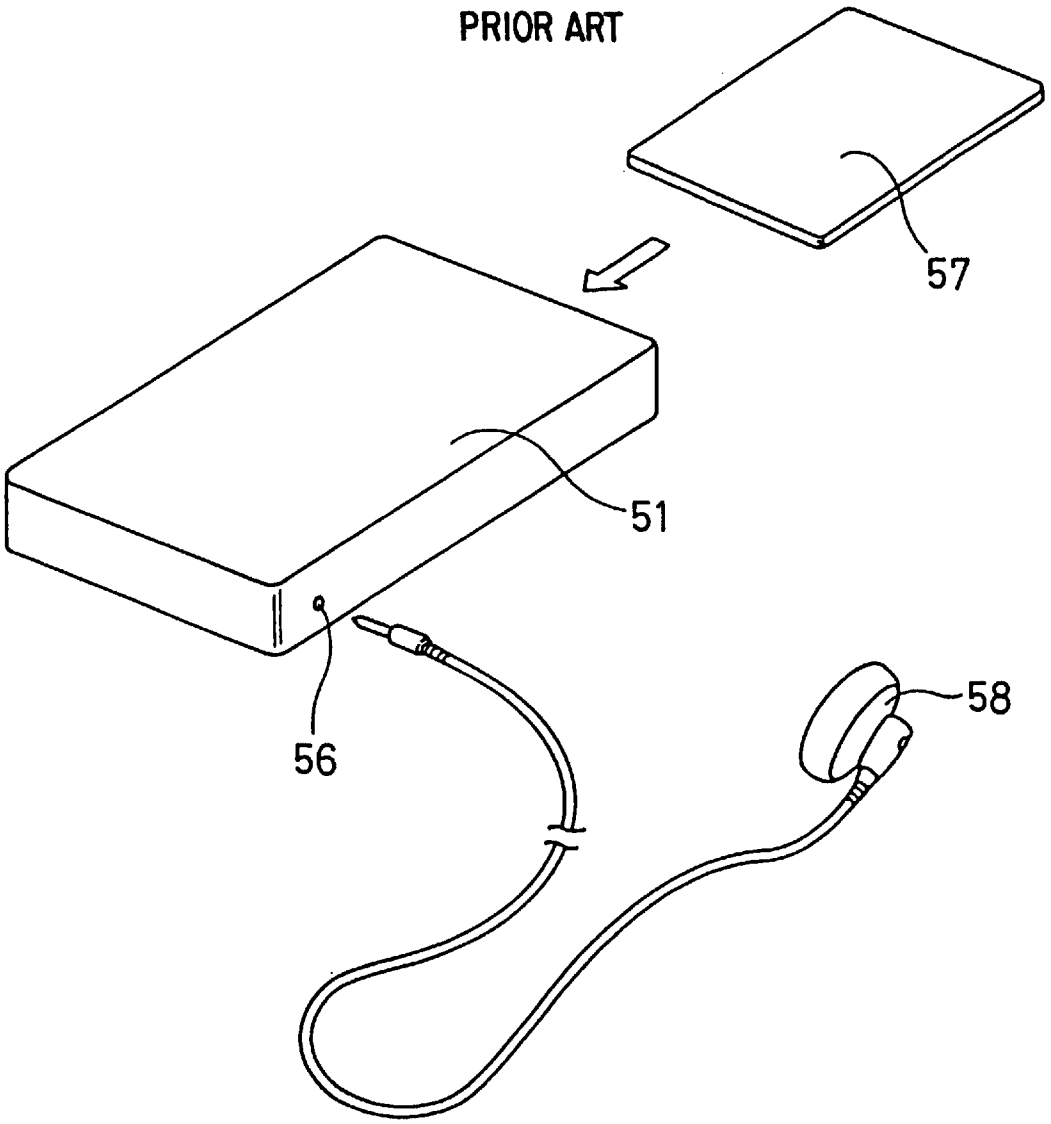
FIG. 4 PRIOR ART
FIG. 4 is a perspective view illustrating the external appearance of a conventional apparatus.
Figure 5:
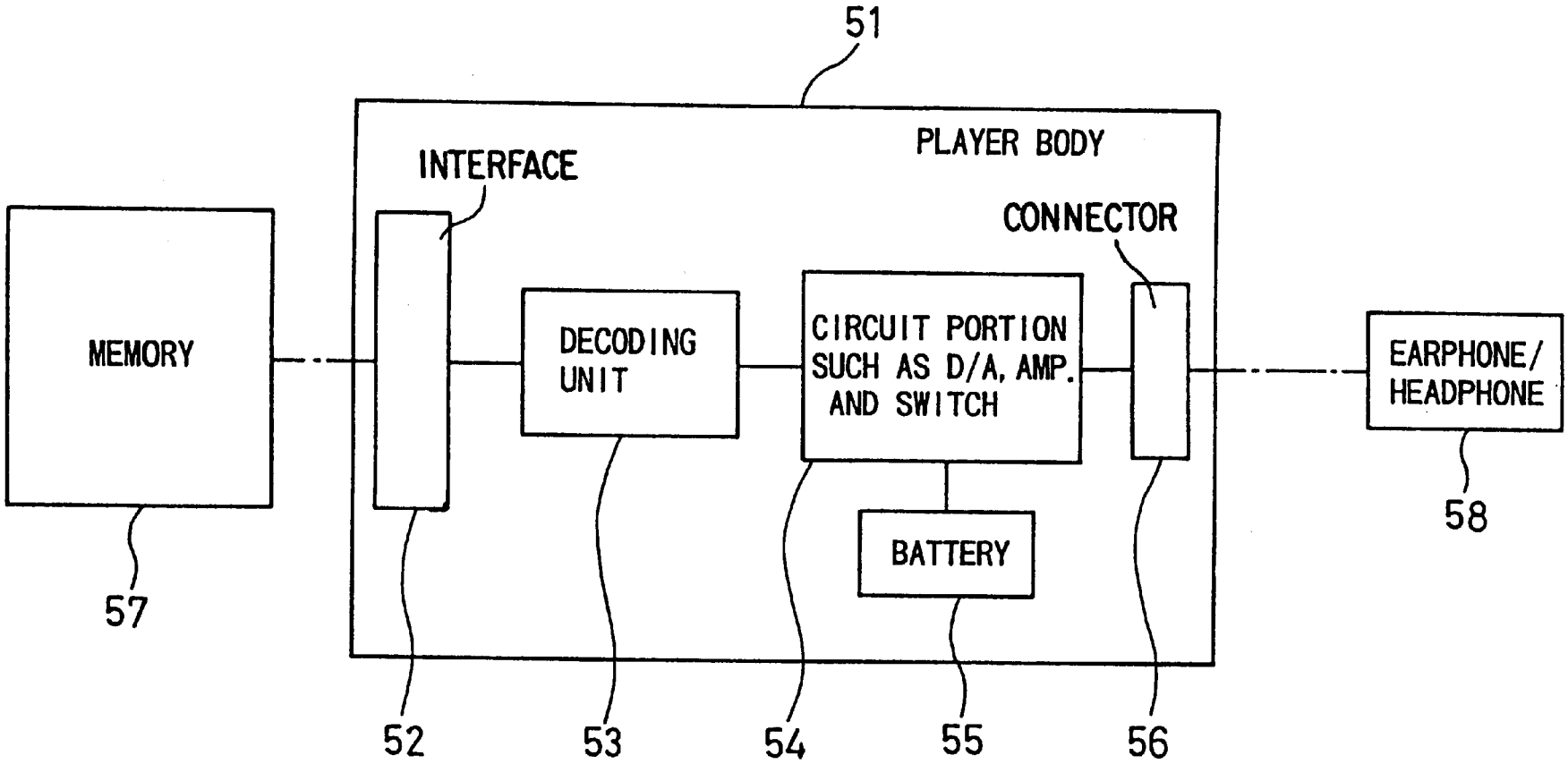
FIG. 5 PRIOR ART
FIG. 5 is a schematic diagram of a conventional apparatus.

Referring now to FIGS. 1 to 3 of the accompanying drawings, a description will be given of an embodiment of the present invention.

In FIG. 1, reference numeral denotes a player body, and a slit (not shown), into which a card 2 serving as an example of a memory-unit accommodating member is inserted, is formed at one end thereof. An earphone 3 is connected to the card 2 via a cable 4. In the illustrated example, the cable 4 for connecting the earphone 3 is integrally attached to the card 2, but may be detachable.

The card 2 has a memory unit 21 which stores voice in the form of compressed codes. The card 2 is provided with a terminal portion having a plurality of contacts (not shown) for connection to an interface 11 of the player body 1, but many of the contacts are used as contacts of a terminal portion 22 for the codes which are sent from the memory unit 21 to a decoding unit 12 via the interface 11, while some of the contacts are used as contacts of a terminal portion 23 for an earphone.

The earphone in this example is integrally connected to the card 2 via the cable 4, and the cable 4 is connected to the terminal portion 23 for an earphone through the circuit of the card 2.

The player body 1 incorporates therein the interface 11, the decoding unit 12, a circuit portion 13, and a battery 14.

The interface 11 is provided with a terminal portion having a plurality of contacts (not shown), but many of the contacts are used as contacts of a terminal portion 15 for connection to the terminal portion 22 of the memory unit 21 of the card 2, while some of the contacts are used as contacts of an output terminal portion 16 connected to the terminal portion 23 for an earphone of the card 2.

The interface 11 has its portion corresponding to the terminal portion 15 connected to the decoding unit 12, and the codes which are received from the memory unit 21 via the interface 11 are expanded by the decoding unit 12, and are transmitted as a digital voice signal. The decoding unit 12 is connected to the circuit portion 13. The circuit portion 13 has a D/A conversion circuit for converting the digital voice signal to an analog voice signal, an amplifier unit for amplifying the analog voice signal to an audible level, a switch for effecting a changeover of operation of the player body 1, and the like. The circuit portion 13 is connected to the battery 14 serving as a power supply, and receives the supply of necessary electric power from the battery. The output side of the circuit portion 13 is connected to the output terminal portion 16 of the interface 11, and an arrangement provided is such that when the terminal portion 23 for an earphone of the earphone 3 is connected to the output terminal portion 16, an output signal drives the earphone 3 and generates voice.

In the apparatus of this embodiment configured as described above, a connector for connection of the earphone 3 is not required, and not only can the apparatus be made compact and inexpensive by that margin, but by simply loading the card 2 into the player body 1, the apparatus can be used, and is very simple.

If the above-described card is loaded in the player body 1, and is connected to the interface 11, the compressed codes are sent from the memory unit 21 to the decoding unit 12 via the terminal portion 15 of the interface 11, and are expanded there, and a digital voice signal is obtained. In the circuit portion 13 the digital voice signal is converted to an analog voice signal by the D/A conversion circuit, and this analog voice signal is amplified to an audible level by the amplifier unit. Such a signal is sent to the earphone 3 via the terminal portion 23 for an earphone of the earphone 3 connected to the output terminal portion 16 of the interface 11, and is generated in the form of voice.

In this embodiment, for the card 2 may be made reusable by rewriting the contents of the memory unit 21, may be made, so to speak, disposable after only one time of use.

Next, FIG. 3 shows another embodiment of the present invention. In this embodiment, a battery 24 is accommodated in the card 2, and this embodiment is characterized in that inspection of the battery becomes unnecessary for the player body 1.

As for the card 2, some of a plurality of contacts of its terminal portion are used as contacts of a terminal portion 25 for a circuit which provides an output of the battery 24 for the aforementioned circuit portion 13, while some of a plurality of contacts of a terminal portion provided in the interface are used as contacts of a terminal portion 17 for a power supply for receiving the output from the battery 24. Accordingly, in this case as well, a connector for connection to the battery 24 is not particularly required.

The card in accordance with the above-described embodiment may adopt a reusable form by making the battery replaceable or chargeable, or may adopt a disposable form.

As described above, in the present invention, since the earphone is connected to the memory-unit accommodating member, and the apparatus is set in a usable state simply by loading the memory-unit accommodating member into the player body, not only can the apparatus be used simply, but since some of the plurality of contacts of the terminal portions of the memory-unit accommodating member and the interface are used for connection of the earphone, the apparatus can be made compact and inexpensive by the margin in which the connectors are not used. In addition, if the battery is accommodated in the memory-unit accommodating member, and the connection to the player body side is effected by using some of the plurality of contacts of the terminal portions of the memory-unit accommodating member and the interface in the same way as described above, the apparatus can be made further compact. If the memory-unit accommodating member is made disposable, inspection concerning the power supply of the apparatus becomes utterly unnecessary. Thus, the apparatus of the present invention becomes very suitable as a voice reproducing apparatus for personal use of the type in which such apparatuses are used individually by a multiplicity of individuals at one time. In addition, by changing the contents of the memory unit, it becomes possible to conduct examinations of different types simultaneously in one examination room, so that the ease of use improves.

What is claimed is:

1. A voice reproducing apparatus for personal use comprising:

a memory-unit accommodating member incorporating therein a memory unit which stores voice as compressed codes;

a player body for converting the codes in said memory unit to a voice signal as said memory-unit accommodating member is loaded therein; and an earphone for reproducing the voice signal into voice, said player body incorporating therein an interface for receiving the codes from said memory unit of said memory-unit accommodating member, a decoding unit for translating the codes into a digital voice signal after expanding the codes, and a circuit portion which includes a D/A conversion unit for converting the digital voice signal to an analog voice signal, an amplifier unit for amplifying the analog voice signal, and a switch for effecting a changeover of operation of said player body, wherein said earphone is connected to said memory-unit accommodating member, some of a plurality of contacts of a terminal portion provided in said memory-unit accommodating member are formed as contacts of a terminal portion for an earphone, some of a plurality of contact of a terminal portion provided in said interface of said player body are formed as contacts of an output terminal portion, and said terminal portion for a cable of an earphone is connected to said output terminal portion when said memory-unit accommodating member is loaded in said player body.

2. A voice reproducing apparatus for personal use according to claim 1, wherein said memory-unit accommodating member incorporates therein a battery for said circuit portion of said player body, some of the plurality of contacts of said terminal portion provided in said memory-unit accommodating member are formed as contacts for a terminal portion for a circuit portion, some of the plurality of contacts of said terminal portion provided in said interface of said player body are formed as contacts of a terminal portion for a power supply, and said terminal portion for a circuit portion is connected to said terminal portion for a power supply when said memory-unit accommodating member is loaded in said player body.

* * * * *